United States Patent [19]

Perry

[11] 4,254,833

[45] Mar. 10, 1981

[54] PORTABLE FIRE EXTINGUISHER WITH LIQUID AND PRESSURE GAS TANKS

[76] Inventor: George Perry, 4800 Cullen Rd., Rte. #3, Fenton, Mich. 48430

[21] Appl. No.: 938,443

[22] Filed: Aug. 31, 1978

[51] Int. Cl.[3] ..... A62C 13/38

[52] U.S. Cl. ..... 169/76; 169/88

[58] Field of Search ..... 169/30, 51-52, 169/71, 75-76, 85, 88; 224/148, 210-216; 239/152-154; 222/175

[56] References Cited

U.S. PATENT DOCUMENTS

| | | | |
|---|---|---|---|
| 632,418 | 9/1899 | Landis | 239/154 X |
| 1,986,407 | 1/1935 | Parker | 239/153 X |
| 2,463,736 | 3/1949 | Benson | 169/30 X |
| 3,286,884 | 11/1966 | Long, Jr. | 222/175 X |
| 3,802,511 | 4/1974 | Good, Jr. | 169/30 |
| 3,844,449 | 10/1974 | Alter | 239/154 X |

FOREIGN PATENT DOCUMENTS

| | | | |
|---|---|---|---|
| 1197163 | 6/1959 | France | 239/153 |
| 946078 | 1/1964 | United Kingdom | 239/152 |

*Primary Examiner*—Charles A. Marmor

*Attorney, Agent, or Firm*—Basile, Weintraub & Hanlon

[57] ABSTRACT

A portable fire extinguisher composed of a portable air tank with a pressure regulator and a liquid carrying tank containing the fire extinguishing liquid. A support bracket carries the liquid carrying tank, and a pair of shoulder straps connecting the support bracket and air tank allow the extinguisher to be carried on the users shoulders. A flexible hose directs the pressure regulated air to the top of the liquid tank. A trigger operated spray nozzle connected to the bottom of the liquid tank by a flexible hose allows the dispersal of a controlled spray of fire extinguishing liquid.

2 Claims, 1 Drawing Figure

PORTABLE FIRE EXTINGUISHER WITH LIQUID AND PRESSURE GAS TANKS

BACKGROUND OF THE INVENTION

I. Field of the Invention

The present invention relates generally to the field of portable fire extinguishers, and more particularly, to a novel and improved fire extinguisher with separate liquid and compressable fluid tanks. The tanks are connected by flexible tubing.

II. Description of the Prior Art

Normally, in portable fire extinguishers or the like, a single tank containing liquid is carried on the users shoulders. The tank usually has a hand pump attached thereto for pumping the extinguishing liquid. One prior invention U.S. Pat. No. 3,802,511 discloses a charged air bottle with the gas contained therein used to drive a pump for pumping water at high pressure. However, none of the prior art discloses a two piece portable fire extinguisher with a compressed gas and pressure regulator on one side of the users shoulders and a tank containing the fire extinguishing liquid on the other side with a trigger actuated nozzle and hose attached to the liquid carrying tank. U.S. Pat. No. 2,463,736 shows two separate tanks disposed on the users chest and back. However, the extra tank only contains reserve liquid while a pump is used to dispense the liquid.

III. Prior Art Statement

The prior art listed hereinbefore includes, in the opinion of the applicant, the closest art of which the applicant is aware.

SUMMARY OF THE INVENTION

The present invention is broadly directed toward an improvement in portable fire extinguishers.

As will be described hereinafter in greater detail in the following description of a preferred embodiment of the invention, the apparatus includes a tank of compressible fluid under pressure and a bent wire support bracket. A pair of shoulder straps connect the top of a compressible fluid tank to the top of the support bracket allowing the user to carry the device on his shoulders.

A liquid carrying tank is mounted in the support bracket. The liquid carrying tank has a pressure release filler cap at the top for filling the tank, and a fluid outlet fitting at the bottom. The fluid outlet fitting has attached thereto a length of flexible hose with a trigger actuated spray nozzle at the other end of the hose. At the top of the liquid carrying tank is a pressure inlet fitting.

The compressible fluid tank has a discharge fitting and a shut off valve attached thereto. Downstream of the shut off valve is a fluid pressure regulator of the type widely available in the marketplace. A length of flexible tubing connects the fluid pressure regulator to the pressure inlet fitting at the top of the liquid carrying tank. The flexible tubing is attached to one of the shoulder straps where it passes over the user's shoulders. A fluid filler valve is attached to the compressible fluid tank for easy recharging of the compressible fluid tank.

A pair of adjustable stabilizing straps are connected between the lower corners of the compressible fluid tank and the lower corners of the support bracket. The stabilizing straps have detachable clips at one end. Soft pads are attached to the inside surfaces of the compressible fluid tank and the liquid carrying tank for the comfort of the user.

It is, therefore an object of the present invention to provide a new and improved fire extinguisher which is a simple and low cost construction and reliable in operation.

Other objects, advantages and applications of the present invention will become apparent by those skilled in the art of portable fire extinguishers, when the accompanying description of one example of the best mode contemplated for practicing the invention is read in conjunction with the accompanying drawing.

BRIEF DESCRIPTION OF THE DRAWINGS

The description herein makes reference to the accompanying drawing wherein the sole FIGURE is a perspective view of a portable fire extinguisher wherein the preferred embodiment of my invention is shown.

DESCRIPTION OF THE PREFERRED EMBODIMENT

Figure 1:
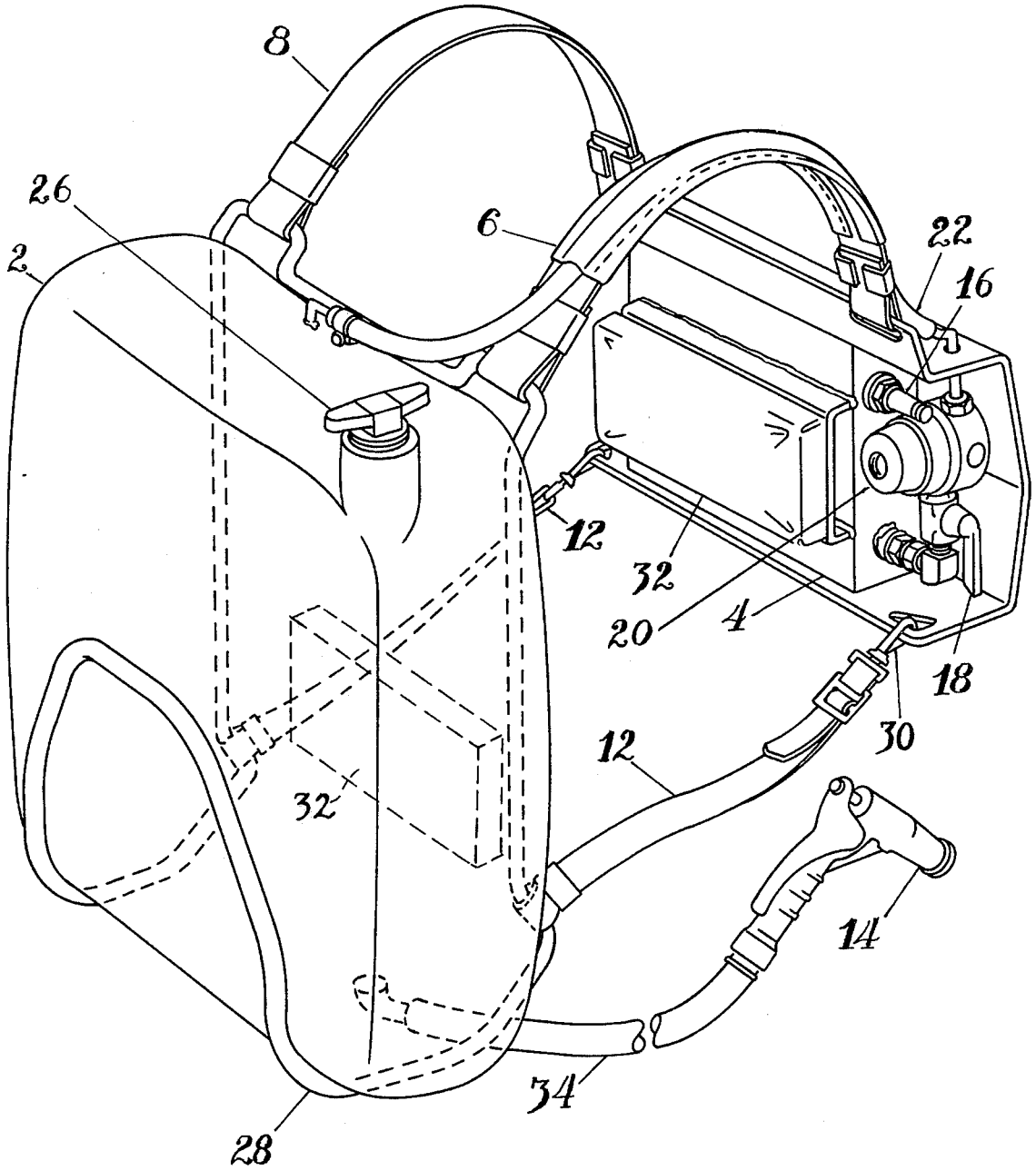

Referring now to the drawing for one example of the present invention relating to portable fire extinguishers, although it is equally applicable in any field where a liquid spray or stream is required.

The portable fire extinguisher comprises a liquid carrying tank 2, a compressible fluid tank 4, shoulder straps 6 and 8, adjustable stabilizing straps 12, spray nozzle 14, and bent wire support bracket 28. A flexible tube connects the liquid carrying tank 2 to spray nozzle 14.

Compressible fluid is introduced into the compressible fluid tank 4 by means of a filler valve 16, generating a pressure within tank 4 thereby. Fluid under pressure flows from tank 4 through shut off valve 18 to pressure regulator 20 where the desired pressure is set by the operator. The regulated pressure is directed to the top of the liquid carrying tank by means of a flexible tube 22. Flexible tube 22 is attached to shoulder strap 6 where it enters a pocket 7 as it passes over the user's shoulder.

Flexible tube 22 is connected to the top of the liquid carrying tank 2. Liquid carrying tank 2 has a pressure release filler cap 26 at its top and a liquid discharge fitting at its bottom. With liquid in the liquid carrying tank 2 and pressure applied through flexible tube 22 to the top of the liquid carrying tank, a copious spray of fire extinguishing liquid can be directed from trigger actuated nozzle 14 by depressing the trigger.

A pair of shoulder straps 6 and 8 connect the top of the compressible fluid tank 4 to the top of the bent wire support bracket 28. Support bracket 28 is overbent bringing the front and rear portions of said bracket slightly toward each other to retain the liquid carrying tank bby compression.

Adjustable stabilizing straps 12 connect the lower corners of compressible fluid tank 4 and bent wire support bracket 28. The adjustable straps 12 are lengthened or shortened according to the size of the user. Quick disconnect clips 30 at one end of the stabilizing straps 12 allow for easy mounting and removal of the fire extinguisher to and from the user's shoulders.

Soft pads 32 attached to the inside surfaces of the compressible fluid tank 4 and the liquid carrying tank 2 prevent the hard and often hot metal surfaces from coming into contact with the user.

What I claim is:

1. A portable fire extinguisher comprising:

a tank of compressible fluid under pressure;

a filler valve for allowing pressurized fluid to be introduced into said tank;

a shut off valve for controlling the dishcarge of fluid from said tank;

a liquid carrying tank with a pressure sealing filler cap at the top, a liquid discharge fitting at the bottom, and a pressurized fluid inlet fitting at the top of said liquid carrying tank;

a bent wire support bracket bent in a form for carrying said liquid carrying tank;

a pair of shoulder carrying straps with one end attached to the top of said compressible fluid tank and the other attached to the top of said bent wire support bracket;

at least one shoulder strap including a pocket with open ends extending along the length thereof;

a flexible conduit connected between said shut off valve and said pressurized fluid inlet fitting;

said flexible conduit secured within said pocket as it passes over the user's shoulder wherein entanglement and damage to the conduit is prevented;

an operator adjustable pressure regulator disposed in said conduit;

a trigger actuated spray nozzle, said spray nozzle attached to said liquid discharge fitting by means of a flexible liquid carrying hose; and a pair of adjustable stabilizing straps attached at one end to the lower inside corners of said compressible fluid tank and at the other end to the lower inside corners of said support bracket.

2. A portable fire extinguisher as defined in claim 1 with soft pads on the inside of said compressible fluid tank and said liquid carrying tank, placed between said compressible fluid tank and said liquid carrying tank and the user.

* * * * *